United States Patent [19]

Bartok et al.

[11] Patent Number: 4,468,231

[45] Date of Patent: Aug. 28, 1984

[54] CATION ION EXCHANGE OF COAL

[75] Inventors: William Bartok, Westfield; Howard Freund, Somerville; Ronald Liotta, Clark, all of N.J.

[73] Assignee: Exxon Research and Engineering Co., Florham Park, N.J.

[21] Appl. No.: 373,883

[22] Filed: May 3, 1982

[51] Int. Cl.[3] ..... C10L 9/06

[52] U.S. Cl. ..... 44/1 R; 44/6; 423/460

[58] Field of Search ..... 44/1 R, 1 SR, 6; 252/447, 179; 423/157, 168, 460

[56] References Cited

U.S. PATENT DOCUMENTS

| | | | |
|---|---|---|---|
| 2,170,065 | 8/1939 | Riley | 423/460 |
| 2,693,452 | 11/1954 | Goedkoop | 252/179 |
| 3,948,791 | 4/1976 | Tominaga et al. | 252/179 |
| 4,039,473 | 8/1977 | Schafer | 423/460 |
| 4,054,420 | 10/1977 | Longanbach | 44/1 SR |
| 4,083,940 | 4/1978 | Das | 44/1 SR |
| 4,200,439 | 4/1980 | Lang | 44/1 R |
| 4,204,843 | 5/1980 | Neavel | 48/210 |
| 4,234,319 | 11/1980 | Beeson | 44/1 R |

FOREIGN PATENT DOCUMENTS 1599932 10/1981 United Kingdom .

OTHER PUBLICATIONS

Pp. 5, 7 and 17 from "Ion Exchange" by Friedrich Helfferich, McGraw-Hill Book Company, Inc., 1962.

Catalysis of the Graphite-Water Vapor Reaction by Alkaline Earth Salts, by D. W. McKee, from Carbon, vol. 17, No. 5-B.

*Primary Examiner*—Carl F. Dees

*Attorney, Agent, or Firm*—Henry E. Naylor

[57] ABSTRACT

Disclosed is a one-step ion-exchange method for organically bonding alkali and alkaline-earth metals onto coal. The method comprises contacting the coal, at a temperature from about 20° C. to about 100° C. with, (a) an aqueous solution containing cations of one or more metals selected from the group consisting of alkali and alkaline-earth metals, and (b) an oxidizing gas.

9 Claims, No Drawings

CATION ION EXCHANGE OF COAL

BACKGROUND OF THE INVENTION

This invention relates to a method of ion exchanging cations onto coal wherein the cations are one or more metals selected from the group consisting of alkali and alkaline-earth metals.

Although coal is by far our most abundant fossil fuel, there are serious problems associated with its use which has prevented it from reaching its full commercial potential. Examples of some such problems include problems in handling, waste-disposal, and pollution. There is also a need in the art for improved methods of pretreating coal to be used in combustion and in catalytic gasification processes. As a result of these problems and needs, oil and natural gas have acquired a dominant position, from the standpoint of fuel sources, throughout the world. This, of course, has led to depletion of proven petroleum and natural gas reserves to an alarming level from both a worldwide energy, as well as an economic point of view.

It is often desirable to have organically bound cations, such as calcium, atomically dispersed throughout the coal structure. These cations can be either naturally occurring or they may be introduced into the coal structure by ion-exchange techniques. Cations such as calcium, which are orgnically bound to the coal structure, are superior to admixtures of coal and inorganic calcium salts, such as limestone, for catalytic reasons, as well as for capturing sulfur in the resulting solid effluent.

Various conventional methods are known for organically incorporating cations into coal structures. For example, U.S. Pat. No. 4,092,125 teaches a hydrothermal method for organically binding, as well as physically incorporating, alkali and alkaline-earth metal ions into the coal structure. The method taught therein comprises mixing fine particles of solid carbonaceous fuel, such as coal, with a liquid solution comprising essentially a hydroxide of sodium, potassium, or lithium and a hydroxide or carbonate of calcium, magnesium, or barium. The mixture is then reacted in a closed reactor from a temperature of about 150° C. to 375° C.

Another conventional method is the method disclosed in U.S. Pat. No. 4,204,843 wherein calcium ions are incorporated into the coal structure by first contacting and soaking the coal with a solution comprising an alkali metal hydroxide at a temperature of about 20° F. to 200° F. to increase the concentration of ion-exchangeable sites within the coal structure. The coal is then further contacted with an alkaline earth metal compound at a temperature form about 20° F. to about 200° F. to replace a portion of the alkali metal cations with alkaline-earth metal cations.

Although processes available in the art have met with various degrees of commercial success, there still exist a need in the art for more economical and less complicated ways of dispersing organically bound cations, such as calcium, into the coal structure.

SUMMARY OF THE INVENTION

In accordance with the present invention there is provided a one-step ion-exchange method for organically bonding alkali and alkaline-earth metal cations onto coal. The coal is contacted at a temperature from about 20° C. to 100° C., with (a) an aqueous solution containing cations of one or more metals selected from the group consisting of alkali and alkaline-earth metals, and (b) an oxidizing gas.

In preferred embodiments of the present invention the cations are calcium, the oxidizing gas is air, and a minor amount of low rank coal is employed with a high rank coal.

DETAILED DESCRIPTION OF THE INVENTION

Although the present invention may be practiced on any type and rank of coal, including lignites, it is particularly useful for higher ranked coals such as bituminous coals. Lignite, and to a lesser extent the lower ranked coals, generally contain a substantial amount of naturally occurring exchange sites, such as carboxyl and hydroxyl groups. On the other hand, higher rank coals lack these naturally occurring sites and therefore must be treated to artifically create such sites before cations can be ion exchanged onto the coal structure. Conventional methods taught in the art usually involve two steps. The first step creates exchange sites on the coal structure and the second step ion exchanges the desired cation onto the coal structure.

In accordance with the present invention, alkali and alkaline-earth metal cations are ion-exchanged throughout the coal structure in only one step. This one step procedure comprises contacting the coal with an aqueous solution containing cations of one or more alkali or alkaline-earth metals at a temperature from about ambient temperature to about the boiling point of the solution, generally about 0° C. to about 100° C., preferably from about 20° C. to about 100° C., and more preferably about 50° C. to about 100° C. in the presence, and intimate contact with, an oxidizing gas, such as air.

Non-limiting examples of oxidizing gases suitable for use herein include air, oxygen, $CO_2$ plus air or oxygen or combinations thereof. Preferred is air. Although it is preferred that the coal be contacted with the aqueous solution at atmospheric pressure, it is to be understood that pressures slightly higher than atmospheric pressure may be employed.

In general, the coal employed in the present invention will be ground to a relatively finely divided state. The particular average particle size, or average particle size range, will depend to a great deal on the optimum size to be used in subsequent processing. Of course, the actual particle size range employed will have some effect on the rate of distribution of cation into the coal structure. In general, the coal will be ground to an average particle size of less than about ¼ inch and preferably to an average particle size of less than about 8 mesh, NBS sieve size.

The coal is contacted with the cation-containing solution for an effective amount of time. That is for at least that amount of time which will give a desired effect. The desired effect is a function of the particular coal and the subsequent process in which the ion-exchanged coal will be employed. For example, if the cation such as calcium is employed for catalytic purposes for coal gasification the relatively low levels would be needed, possibly 5 wt. % on coal, or less. If the cation, in particular calcium, is ion-exchanged onto the coal structure to capture sulfur in a subsequent gasification or combustion process then an atomic ratio of organically bound calcium to sulfur of at least 0.8 to 1 may be needed. The precise amount of cation which is to be ion-exchanged onto the coal structure by the practice of the present invention can easily be determined by routine experimentation or calculation by one having ordinary skill in the art.

For purposes of the present invention, a minor amount (as little as about 3 wt. %, based on the total weight of the coal sample) of a relatively low rank coal can be employed with a high rank coal. The lower rank coal has been found to facilitate the exchange of metal cation onto the higher rank coal.

As previously discussed, after treating the coal in accordance with this invention, it will generally be conveyed on to a combustion, liquefaction, or gasification process. It is not critical to the present invention which specific process is subsequently employed. For example, in various gasification and liquefaction processes, the cation will act as a catalyst and to capture sulfur whereas in a combustion process, the cation, if calcium, will act to capture sulfur in the resulting solid effluent.

The following examples serve to more fully decribe the present invention, as well as to set forth the best mode contemplated for carrying out the invention. It is understood that these examples in no way serve to limit the true scope of the invention, but rather are presented for illustrative purposes.

EXAMPLE 1

10g of Illinois #6 coal was mixed with 275 ml of water and 5g of calcium hydroxide. The mixture was slurried for 5 hours at 80° C. with air sparging therethrough. In each of the examples herein, the treated coal was washed to remove excess calcium, and dried. The dried coal was then studied by Infrared Analysis which revealed the presence of calcium carboxylates. The coal sample was acidified with concentrated HCl to ion-exchange protons for calciums on the carboxylates. The coal was then oxygen-alkylated with labeled methyl groups according to the procedure set forth in JACS 1981 vol. 103 p. 1735. This procedure enables one to determine the total number of carboxyl sites. The oxygen-alkylated derivative was then treated with concentrated HCl which hydrolyzed off all of the labeled methyl ester groups. The number of methyl ester groups so hydrolyzed corresponds to the total number of carboxylates after treatment. The number of carboxyl sites added to the coal structure by the practice of this invention can be determined by subtracting the number of carboxyl sites per 100 carbon atoms present in the original coal structure from the total number of carboxyl sites found after treatment. Illnois #6 coal, before treatment, contains about 0.3 carboxyl sites per 100 carbon atoms.

Table I below sets forth the results obtained for the examples herein.

EXAMPLE 2

The procedure and ingredients of Example 1 above was followed except 0.5g of Big Brown coal was used in addition to 10g of Illinois #6 coal. Big Brown coal, before treatment, was found to contain about 4 carboxyl sites per 100 carbon atoms. The resulting data in Table I below illustrates the advantages of employing a small amount of low rank coal containing a relatively large number of carboxyl groups with a higher rank coal. The low rank coal facilitates the exchange of calcium onto the higher rank coal.

EXAMPLE 3

The procedure and ingredients of Example 2 above were followed except the coal was slurried for a period of 18 hours.

EXAMPLE 4

The procedure and ingredients of Example 3 above were followed except calcium carbonate was used instead of calcium hydroxide and the coal was slurried for 18 hours.

Table I below sets forth the concentration of organically bound calcium in the coal samples when treated in accordance with the respective above examples. As previously discussed, the concentration of organically bound calcium is determined by measuring the number of carboxyl sites per 100 carbon atoms and thus obtaining the weight percent calcium, based on the total weight of the dried treated coal.

TABLE I

| Example | No. of carboxyl groups per 100 carbon atoms | Wt. % $C_a$ |
|---|---|---|
| 1 | 0.5 | 1.3 |
| 2 | 0.8 | 2.1 |
| 3 | 1.2 | 3.2 |
| 4 | 1.2 | 3.2 |

What is claimed is:

1. A one-step ion-exchange method for organically bonding alkali and alkaline-earth metal cations onto coal, which method comprises: slurrying the coal, at a temperature from about 20° C. to about 100° C., with an aqueous solution containing cations of one or more metals selected from the group consisting of alkali and alkaline-earth metals and wherein an oxidizing gas is passing through the slurry.

2. The method of claim 1 wherein the oxidizing gas is air.

3. The method of claim 1 or 2 wherein the cations are of an alkali metal.

4. The method of claim 3 wherein the alkali metal is potassium.

5. The method of claim 1 or 2 wherein the cations are of an alkaline-earth metal.

6. The method of claim 5 wherein the alkaline-earth metal is calcium.

7. The method of claim 1 or 2 wherein the coal is a mixture having a major proportion of bituminous or higher rank coal with the balance being a coal of lower rank than bituminous coal.

8. The method of claim 3 wherein the coal is a mixture having a major proportion of bituminous or higher rank coal with the balance being a coal of lower rank than bituminous coal.

9. The method of claim 5 wherein the coal is a mixture having a major proportion of subbituminous or higher rank coal with the balance being a coal of lower rank than subbituminous coal.

* * * * *